US006836746B2

(12) United States Patent
Coder et al.

(10) Patent No.: US 6,836,746 B2
(45) Date of Patent: Dec. 28, 2004

(54) METHOD AND APPARATUS FOR CALCULATING THE PAYLOAD ON A WATER-BORNE VESSEL

(75) Inventors: James Richard Coder, Norwood, MN (US); Joshua Lars Coder, Green Isle, MN (US); Caleb Theodore Coder, Norwood, MN (US)

(73) Assignee: Control Stuff, Inc., Cologne, MN (US)

( * ) Notice: Subject to any disclaimer, the term of this patent is extended or adjusted under 35 U.S.C. 154(b) by 0 days.

(21) Appl. No.: 10/113,068

(22) Filed: Apr. 1, 2002

(65) Prior Publication Data

US 2003/0187611 A1 Oct. 2, 2003

(51) Int. Cl.[7] ..... G06F 15/00; G06F 15/20

(52) U.S. Cl. ..... 702/174; 414/137.1; 701/124

(58) Field of Search ..... 702/43, 45, 51, 702/173, 174; 701/124; 73/178, 302, 304; 414/138.3, 137.1, 139.7; 177/1, 136, 210 A

(56) References Cited

U.S. PATENT DOCUMENTS

| | | | | |
|---|---|---|---|---|
| 3,128,375 A | | 4/1964 | Grimnes | 702/43 |
| 3,190,119 A | | 6/1965 | Isobe et al. | 73/302 |
| 3,296,863 A | | 1/1967 | Levine | 73/304 R |
| 3,334,608 A | | 8/1967 | Nemoto et al. | 114/74 R |
| 4,218,168 A | | 8/1980 | Parsons | 414/139.7 |
| 4,347,574 A | | 8/1982 | Parsons | 701/124 |
| 4,523,460 A | * | 6/1985 | Strickler et al. | 73/200 |
| 4,534,217 A | | 8/1985 | Caus | 73/178 R |
| 4,872,118 A | | 10/1989 | Naidenov et al. | 701/124 |
| 4,945,775 A | * | 8/1990 | Adams et al. | 73/856.8 |
| 5,154,561 A | | 10/1992 | Lee | 414/138.3 |
| 5,547,327 A | | 8/1996 | Bachalo et al. | 414/137.1 |

* cited by examiner

*Primary Examiner*—John Barlow
*Assistant Examiner*—John Le
(74) *Attorney, Agent, or Firm*—Fredrikson & Byron, P.A.

(57) ABSTRACT

Mass of a payload delivered to a water-borne vessel is provided with high accuracy and without the need for human measurement or the need for personnel to enter the water. The draft of the vessel in an unloaded or empty condition is compared to a loaded or loading condition. A plurality of sensors positioned about the perimeter of the vessel's deck at a height above the waterline produce signals representative of their height above the waterline. These signals are then transmitted to a processor, which calculates the volume and mass of the payload utilizing volumetric equations and the payload's known density. In one embodiment, the sensors are coupled to radio transmitting devices that transmit the signals to the processor. In an alternative embodiment, the sensors are positioned and attached as described above such that the distance between each sensor at the port, starboard, fore, and aft positions of the deck are measured and inputted into a processor, which calculates the volume and mass of the payload as described above.

27 Claims, 3 Drawing Sheets

METHOD AND APPARATUS FOR CALCULATING THE PAYLOAD ON A WATER-BORNE VESSEL

FIELD OF THE INVENTION

The present invention relates to a method and apparatus for accurately determining the volume mass of a payload delivered to a water-borne vessel.

BACKGROUND OF THE INVENTION

Accurately determining the mass of material (i.e., a payload) delivered to and loaded on a water-borne vessel, such as, a barge, is important to prevent overloading of the vessel. Overloading a vessel may cause it to sink or bottom out in the waterway in which it is traveling, creating a dangerous situation.

Traditional methods of determining the payload, known as "drafting the vessel," involve the visual reading of draft lines painted on the side of the vessel. These measurements must be made manually by personnel on the vessel, both when it is empty and again after the vessel is loaded to determine the payload's displacement of the vessel into the water. The measurements obtained from this method are then used in a formula to calculate the payload delivered into the vessel.

The traditional method has several limitations. First, manual measurements have limited accuracy and are not always reliable. This is due to variations in depth perception and human error. Second, because the water level fluctuates from moment to moment due to water disturbances from wave action, accurate measurements are difficult to obtain manually. Finally, because it is not possible to uniformly load a vessel, the port-starboard (list) and fore-aft (trim) planes are not level, thereby allowing for inaccurate estimation of the mass depending on the distribution of the payload in the vessel. In addition, the traditional methods may not take into account the twisting of the vessel caused by non-uniform loading. Non-uniform loading causes not only vertical (list) and horizontal (trim) perturbations but also can cause perturbations along a diagonal axis running from opposite corners of the vessel.

As a result of the aforementioned drawbacks, large and costly errors are made in the calculations of payloads based on traditional methods. Current methods have attempted to improve upon the accuracy of determining the weight of the payload. This has involved, in part, the use of sensors to measure the displacement of the vessel caused by the weight of the payload. For example, U.S. Pat. No. 5,547,327 issued to Bachalo describes an automated loading system for floating water-borne vessels. In this system the draft of the vessel is measured by means of pressure sensors located on the outside of the vessel below the level of water. The sensors then transmit pressure signals proportional to their depth in the water to a computer that performs the relevant calculations.

Although the above-described drafting method may eliminate the inaccuracies associated with human error, other aspects of the system are problematic. First, because the sensors are positioned underwater, they are susceptible to damage during transit (such as by collision with floating debris or protrusions from the bottom of the waterway). This makes it necessary for an operator to attach and detach the sensors before and after loading, possibly subjecting the operator to the dangers associated with working in the water in the vicinity of vessels. If the sensors are not removed and damage occurs, the underwater positioning would make them difficult to access for repair and subject the repairperson to the dangers associated with entering the water, especially when ice has formed over part of the water surface.

It would be desirable to provide a method and apparatus to accurately measure the payload delivered to a water-borne vessel that eliminates the hazards and inefficiency associated with attaching, detaching, or repairing underwater sensors and the inaccuracies associated with measurements made by humans. Further, it is desirable to provide for an accurate determination of the list, trim, and twist of the vessel to ensure a highly accurate determination of the payload delivered to the vessel.

SUMMARY OF THE INVENTION

In accomplishing the stated objectives of the invention, the mass of a payload introduced into a water-borne vessel is measured by means of an apparatus that compares the draft of the vessel in an unloaded or empty condition to a loaded or loading condition. The system is comprised of a plurality of sensors positioned about the perimeter of the vessel's deck at a height above the waterline. The sensors produce signals representative of their height above the waterline. These signals are then transmitted to a processor, which calculates the volume and mass of the payload utilizing volumetric equations and the payload's known density. In one embodiment, the sensors are coupled to radio transmitting devices that transmit the signals to the processor. In an alternative embodiment, the sensors are positioned and attached as described above such that the distance between each sensor at the port, starboard, fore, and aft positions of the deck are measured and inputted into a processor, which calculates the volume and mass of the payload as described above.

Another aspect of the invention provides a method for determining the mass of payload introduced into a water-borne vessel by comparing the draft of the vessel in a loaded or loading condition to the vessel's draft in an un-loaded or empty condition. In accordance with the method, a plurality of sensors is positioned about the perimeter of a water-borne vessel by means that allow for convenient attachment and detachment. The draft of the vessel is generated from signals, representative of the distance from each sensor to the waterline, produced by the sensors. Finally, the signals are sent to a processor to determine the volume and mass of the payload from the draft information obtained from the sensors.

DETAILED DESCRIPTION

Figure 1:
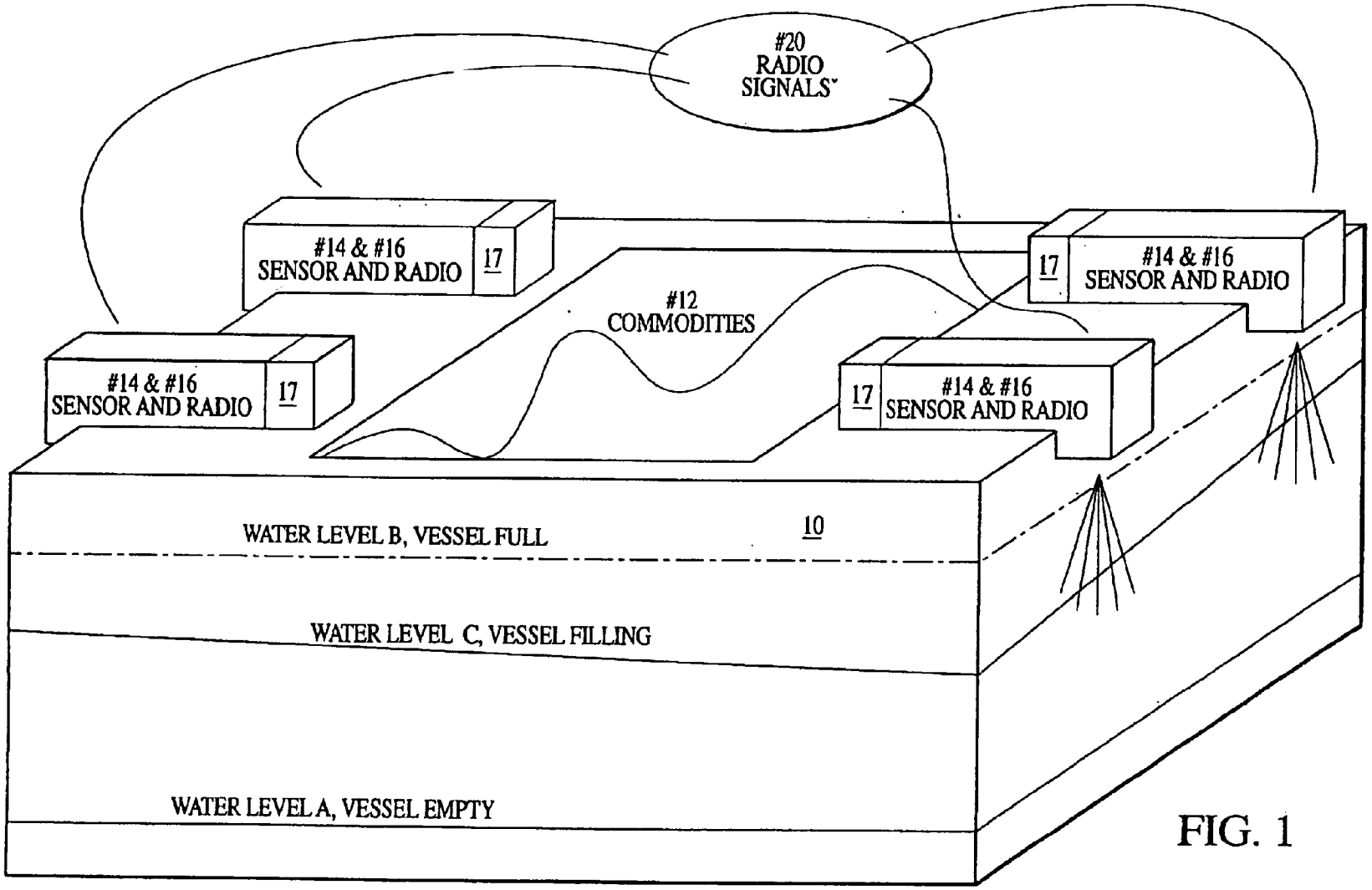
FIG. 1 is a schematic diagram a water-borne vessel equipped with apparatus of the invention.

To assist in an understanding of the invention, a preferred embodiment or embodiments will now be described in detail. Reference will be frequently taken to the figures, which are summarized above. Reference numerals will be used to indicate certain parts and locations in the figures. The same reference numerals will be used to indicate the same parts or locations throughout the figures unless otherwise indicated.

Figure 2:
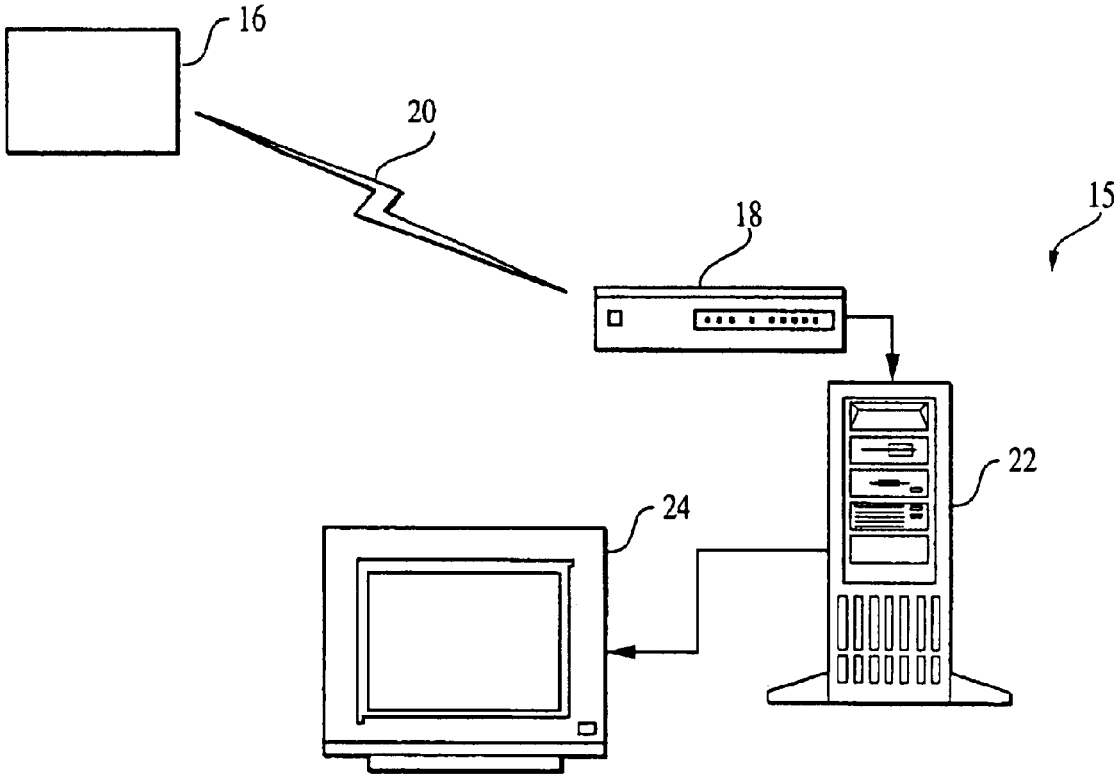
FIG. 2 is a schematic diagram of the processing system in accordance with the invention.

FIG. 1 is a representative schematic diagram a water-borne vessel 10 equipped with an apparatus of the present invention and FIG. 2 is a representative schematic diagram of processing system 15 in accordance with the present invention. With reference to FIGS. 1 & 2, the apparatus of the present invention is comprised of ultrasonic level sensors 14, removably attached to a vessel 10 of any type able to transport materials 12, transceivers 16, antenna 17 and processing system 15, which is comprised of receiving station 18, a computer 22 and a user interface 24. The apparatus of the present invention is discussed in more detail below with a detailed description of each element of the present invention.

FIG. 1 depicts a generalized vessel 10, for example, a barge, adapted to transport materials 12. It is to be understood that the present invention is not limited to practice with any particular type of vessel or materials. To the contrary, all aspects of the present invention can be practiced in connection with any type of water-borne vessel adapted to be loaded with material, such as barges, tankers, and freight vessels, transporting any type of material, such as corn, oil, and cars. As depicted in FIG. 1, loading vessel 10 with material 12 causes a change in the draft of vessel 10. As vessel 10 is loaded with material 12, water is displaced causing vessel 10 to draft. In FIG. 1 vessel 10 is depicted at different drafts designated by representative lines A and B. Line A representatively depicts a waterline in the vessel's unloaded or empty state whereas line B representatively depicts a waterline in the vessel's loaded or loading state. Unloaded or empty, for the purposes of this description, refers to the state of the vessels cargo or holding area and does not refer to any ballast tanks, trim tanks, or crew berthing compartments, etc.

In a preferred embodiment of the invention, sensors 14 are ultrasonic level sensors 14 and are positioned at suitable locations about the perimeter of vessel 10. Sensors 14 can be any sensor, such as TR-89/B sold commercially by the Massa Corporation or the UL400 sold commercially by Global Water, however, for purposes of this discussion sensors 14 are US10 Self Contained Ultrasonic Sensors commercially available from Scientific Technologies, Inc located in Logan Utah. It is noted that the present invention is not limited to practice with ultrasonic level sensors, but may include any type of level or position sensing device, such as optical sensors or even conductivity sensors. For example, in an alternative embodiment sensors 14 can be photoelectric level sensors. Preferably four sensors 14 are removably attached at each of the four corners of vessel 10 at a level, such as the deck of the vessel, that is above the waterline in the loaded, loading, and unloaded states (lines A and B). It is understood that not all vessels have four corners. For these vessels, sensors 14 are preferably removably attached at locations, above the waterline in the loaded, loading, and unloaded states, representative of the starboard/fore, starboard/aft, port/fore, and port/aft-most positions of the material holding area of vessel 10. Further, it is preferable if sensors 14 are mounted on a swivel so that sensors 14 remain at 90° to the water's surface at all times thus ensuring accurate draft measurements. Therefore, no matter how much vessel 10 lists and trims the sensor's readings of the draft remain very accurate. As is apparent, the positioning of sensors 14 allows for convenient removal and maintenance of sensors 14 without the need for personnel to undertake the risks associated with entering the water. Furthermore, it can be appreciated that sensors 14 are not susceptible to damage caused by collision with objects under the waterline. Therefore, sensors 14 may also be permanently installed on vessel 10 if so desired. However, preferably, the sensors are removably affixed to vessel 10 such that sensors 14 are affixed prior to loading of materials 12 and removed after the loading is complete to prevent any accidental contact with sensors 14. Finally, it is contemplated that more than four sensors could be used to improve the accuracy of the draft readings and thus the calculations of the mass of material 12, however, it is understood that as more sensors are used, the cost increases. Therefore, in a preferred embodiment, only four sensors are utilized. It is also contemplated that less that four sensors could be used, however, as fewer sensors are used the accuracy of the draft readings and thus the calculations of the mass of material 12 decreases. It is further contemplated that sensors 14 could be placed in other locations on vessel 10 without departing from the spirit of the present invention.

As depicted in FIG. 1, line C represents a non-uniform draft line of vessel 10 loaded with material 12. The possibility that material 12 may be loaded non-uniformly is ever present. This non-uniform loading causes listing of the fore/aft plane or trimming in the starboard-port plane. In addition, vessel 10 may twist under the non-uniform weight distribution. Such perturbations must be accounted for in order to obtain an accurate measurement of the draft and thus an accurate measure of the weight of material 12. Positioning sensors 14 in accordance with a preferred embodiment, at the four corners of vessel 10, facilitates the measurement of the list and trim, which can then be used to obtain information regarding the twisting or torquing of the vessel. Then upon discovery of the twisting or torquing, the vessel operator can give instructions to either suspend loading of material 12 or instructions on to load material 12 at a different location in vessel 10 to prevent or remedy any twisting and torquing.

Each sensor 14 measures the distance between itself and the waterline (lines A, B, and C) below and generates a signal representative of such distance. In a preferred embodiment, sensors 14 are digital and produce digital signals, however, the use of analog sensors is contemplated. Sensors 14 can be deployed before, during, and after loading. However, in a preferred embodiment, the sensors are deployed before introduction of any material 12 to provide the most accurate calculation of material 12 introduced. Alternatively, the draft of a particular vessel or vessel type, when unloaded, could be pre-determined and stored for later comparison against the draft of the vessel when loaded. In such a scenario, the sensors need only to be placed in the same general area where the pre-determined draft reading was taken in order to insure reasonably accurate draft readings by sensors 14, This is because the draft can vary at different locations around the vessel. However, the procedure of deploying sensors 14 prior to loading is preferred over loading the vessels characteristics from a stored data set because vessel 10 may have flooded and/or emptied its ballast tanks since the recording of the stored data set, which can influence the draft of vessel 10.

Preferably, sensors 14 are equipped with or operatively connected to a microprocessor, such as the Pentium 4 commercially sold by Intel®, a microcontroller, such as the M68HC11 commercially sold by Motorola®, or a digital signal processor (not shown), such as the DSP56800 commercially sold by Motorola, each one utilizing filtering algorithms commonly known that can correct for irregularities or perturbations in the data sampled by sensors 14 due to waves or other sporadic movements on the surface of the water. In an alternative embodiment, computer 22 in processing system 15 executes the filtering algorithms. According to another possible embodiment, sensors 14 are equipped with a thermometer capable of recording and transmitting information regarding the ambient air temperature surrounding the water. This data, in turn, can be used to correct for the effects of temperature on the subsequent payload calculations. This is because water is denser when it is cold and less dense as it becomes warm. This means that in cold water, the draft recorded will be larger than the draft recorded with the same load if the water was warmer. Therefore, by knowing the temperature of the water the calculations, discussed in more detail below, are more accurate by adjusting for the actual density of the water.

In general, ultrasonic level sensors 14 determine distance by directing an ultrasonic beam a short distance towards the water and measuring the time it requires for the beam to bounce off the water and return to the sensor. This measurement data is then sent to processing system 15, which utilizes commonly known physics algorithms to translate the measured time into a distance. Sensors manufactured to measure large distances have lower accuracies and are costly. In accordance with the present invention, advantage is taken of less costly and more accurate sensors since it is only necessary to employ sensors with accuracy ranges inclusive of the maximum draft of the vessel.

In accordance with another aspect of the invention, sensors 14 are powered by rechargeable batteries (not shown), such as the PS-12120 commercially available from the Power-Sonic Corporation, which is a lead-acid battery providing approximately 12 Volts and 12 Amp hours. It is contemplated that sensors 14 may be powered by any power supply, such as a standard wall outlet, non-rechargeable batteries, or solar power cells, without departing from the spirit of the invention. In a preferred embodiment, sensors 14 are capable of monitoring and transmitting information regarding the charge state of the batteries. A charging station (not shown), such as the PSC-12-10A commercially available from the Power-Sonic Corporation, may be provided to recharge the batteries as needed.

With reference again to FIG. 1, each sensor 14 is shown coupled to a transceiver 16. Transceivers 16 can be any type of low power transceiver, such as a multi-channel low power transceiver commercially available from ITT Industries or the XE1201A transceiver commercially available from Xemics®, however; transmitters 16 are preferably a Datalink transceiver commercially available from VYTEK Wireless, Inc., located in Vista Calif., and are coupled to at least one antenna 17. Antenna 17 can be any type of low power antenna however; antenna 17 is preferably a low power antenna compatible with or part of the Datalink transceiver. Transceivers 16 can transmit digital or analog signals 20 from sensors 14 containing information regarding depth, battery charge, and possibly temperature. Preferably, the transmission is wireless via radio frequency signals 20 generated by each sensor. However, other hard-wired or wireless transmission methods could be used, such as standard cable, fiber optics, or infrared, without departing from the spirit of the invention. In addition, two or more sensors could be tied into a single transmitter that transmits a single signal containing data generated by the sensors transmitted separately through time or frequency multiplexing.

As depicted in FIG. 2, processing system 15 receives signals 20 transmitted by transceivers 16. Receiving station 18 is comprised of a transceiver (not shown), which is identical to those coupled to sensors 14 to ensure reliable data transfer and a conventional transformer to provide the desired power. Receiving station 18 is operatively connected to a computer 22 comprising a processor with memory and various interface devices 24, such as a monitor, a keyboard, mouse, or a kiosk. Processing system 15 may be placed anywhere onboard vessel 10 within reliable transmitting and receiving range of transceivers 16 and receiving station 18. Preferably, computer 22, receiving station 18, and user interface 24 are housed in a NEMA-12 (National Electrical Manufactures Association) console type enclosure such as the Eurobex 2500 CA commercially available from Eurobex to protect the devices. Further, preferably computer 22 is a specially designed industrially hardened computer, which prevents the vibrations and movement of vessel 10 from transferring to the hard drive of computer 22 and thus destroying the hard drive or preventing efficient transfer of information.

In a preferred embodiment, the receiving station 18 is coupled to computer 22 or other type of information processor in a known manner. The receiving station 18 demodulates received sensor signals 20 and directs the data to computer 22, which performs the relevant computations, which are discussed in more detail below. Computer 22 is loaded with software or other instructions capable of manipulating the data produced by sensors 14. In a preferred embodiment, computer 22 is an industrially hardened computer executing Windows® CE. The software required for receiving and manipulating the received sensor data is specifically developed to handle the mathematical equations and operates within Windows® CE. In a preferred embodiment the software is a GUI based application capable of displaying representations of the vessel with a real-time depiction of the list and trim. In accordance with this aspect of the invention, it is possible to monitor the list and trim during the loading process thus providing notice of overloading in a particular area of the vessel.

During and after material 12 loading it is desirable to determine the payload delivered to vessel 10. The aforementioned computer software, utilizing measurements made by sensors 14 and parameters particular to vessel 10, enable computer system 22 to compute the payload introduced into a vessel of a known type. The program utilizes mathematical volume equations to calculate the change in displacement, (of vessel 10 into the water due to loading) derived from known geometric shapes. In the example below, an exemplary equation is used to calculate the volume of material 12 on a Rake barge. However, it is contemplated that other volumetric equations could be utilized to calculate the volume of material 12 on vessel 10 without departing from the spirit of the invention as long as the volumetric equations substantially correlate with the dimensions of the cargo compartment of vessel 10 (e.g., preferentially you would not use the volumetric equations for a cylinder to calculate the volume of the material in a rectangular cargo compartment). In one embodiment of the present invention, a plurality of equations are stored in a table in memory and then upon the user inputting what type of vessel will be transporting material 12 an equation is retrieved and utilized to calculate the volume of material 12. In another embodiment, much simpler equations are utilized to make efficient use of the computers processing time and thus a much less powerful or less expensive processor in computer 22 could be utilized. In another embodiment, the software is specially designed for each vessel and therefore only one equation is necessary.

With reference to Table I below, variables, variable descriptions, and data sources for an exemplary equation are shown.

TABLE I

Variable Explanations.

| Variable | Data Source | Description |
|---|---|---|
| $z_1$ | Sensor | Aft port vertical length of barge below water. |
| $z_2$ | Sensor | Fore port vertical length of barge below water. |
| $z_3$ | Sensor | Fore starboard vertical length of barge below water. |
| $z_4$ | Sensor | Aft starboard vertical length of barge below water. |
| w | Data Table/ Manual Entry | Width of barge storage compartment. This is a stored value or operator entered. |
| $I_1$ | Data Table/ Manual Entry | Length of the lower horizontal surface of the storage compartment of the barge. This is a stored value or operator entered. |
| $I_2$ | Data Table/ Manual Entry | Length of the upper horizontal surface of the storage compartment of the barge. This is a stored value or operator entered. |
| h | Data Table/ Manual Entry | Perpendicular distance between $I_1$ and $I_2$. Overall height of vessel 10. This is a stored value or operator entered. |
| $z_1'$ | | $z_1 + [(z_2 - z_1) \cdot (z_1 \cdot \tan(\theta))]/I_1$ |
| $z_2'$ | | $z_1 + [(z_2 - z_1) \cdot (I_1 + z_1 \cdot \tan(\theta))]/I_1$ |
| $z_3'$ | | $z_4 + [(z_3 - z_4) \cdot (I_1 + z_4 \cdot \tan(\theta))]/I_1$ |
| $z_4'$ | | $z_4 + [(z_3 - z_4) \cdot (z_4 \cdot \tan(\theta))]/I_1$ |
| $y_1$ | | $-z_1 \cdot \tan(\theta)$ |
| $y_2$ | | $z_2 \cdot \tan(\theta)$ |
| $y_3$ | | $z_3 \cdot \tan(\theta)$ |
| $y_4$ | | $-z_4 \cdot \tan(\theta)$ |
| $\theta$ | | $\tan^{-1}((I_2 - I_1)/(2h))$ |
| $e_1$ | | $z_4' - z_1'$ |
| $e_2$ | | $z_2' - z_1'$ |
| $e_3$ | | $z_4 - z_4'$ |
| $e_4$ | | $z_3' - z_2'$ |
| $e_5$ | | $z_2 - z_2'$ |
| $e_6$ | | $z_1' - z_4'$ |
| a | | $-e_1 \cdot I_1$ |
| b | | $-e_2 \cdot w$ |
| c | | $w \cdot I_1$ |
| $a_1$ | | $y_4 \cdot e_1$ |
| $b_1$ | | $-w \cdot e_3$ |
| $c_1$ | | $w \cdot y_4$ |
| $d_1$ | | $y_1 - y_4$ |
| $b_2$ | | $-w \cdot z_4$ |
| $c_2$ | | $w \cdot y_4$ |
| $d_2$ | | $y_3 - y_2$ |
| $a_3$ | | $-y_2 \cdot e_4$ |
| $b_3$ | | $-w \cdot e_5$ |
| $c_3$ | | $w \cdot y_2$ |
| $b_4$ | | $-w \cdot z_2$ |
| $c_4$ | | $w \cdot y_2$ |

Figure 3:
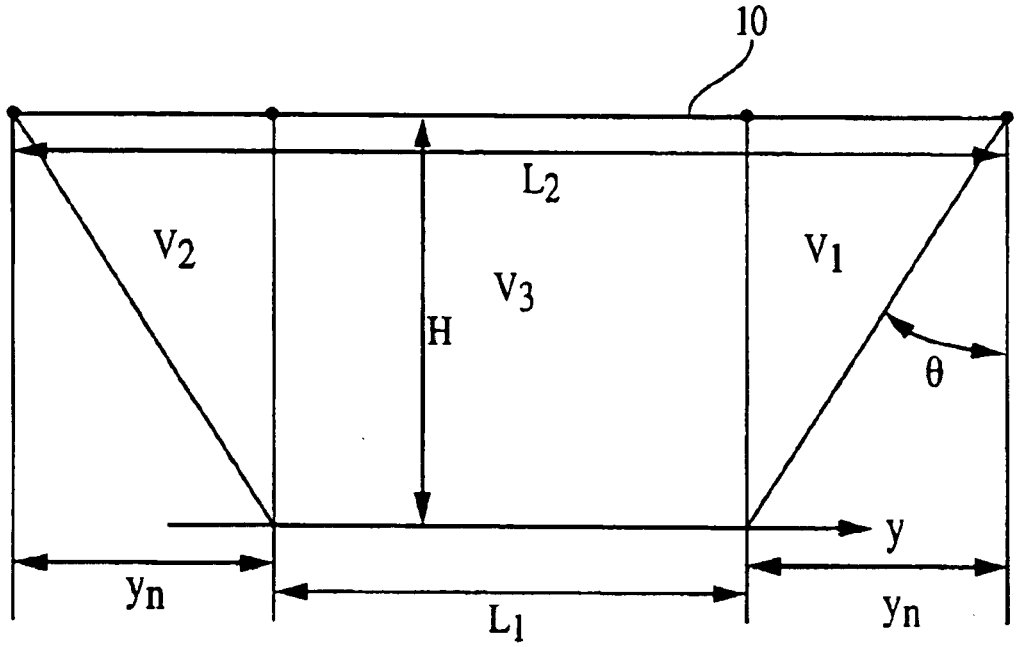
FIG. 3 is a representative front profile of Rake barge.

FIG. 3 is a representative front profile of Rake barge. With reference to FIG. 3 and the Table above, a proper understanding of the exemplary equation is now discussed. The equation involves using integral calculus to determine the volume that lies between the two planes (e.g., the draft line when vessel 10 is empty "A" and the draft line when vessel 10 is loading or loaded "B", FIG. 1) for three different parts, ($V_1$, $V_2$, and $V_3$) of the Rake barge. The sum of the three parts is substantially equal to the total volume ($V_t$) of the Rake barge, represented by equation 1 below.

$$V_t = \sum_{1}^{3} V_n \tag{1}$$

Therefore, equation 2 becomes the overall volume equation.

$$V_1 = wL_1 z_1^* - \frac{aw^2 L_1}{2c} - \frac{bwL_1^2}{2c} + \frac{z_4^* d_1 w}{2} + z_4^* y_4 w - \frac{a_1 d_1 w^2}{3c_1} - \frac{a_1 w^2 y_4}{2c_1} - \frac{b_1 d_1^2 w}{6c_1} - \frac{b_1 y_4^2 w}{2c_1} - \frac{b_1 y_4 d_1 w}{2c_1} + \frac{b_2 d_1^2 w}{6c_2} + \frac{b_2 y_4 d_1 w}{2c_2} + \frac{b_2 y_4^2 w}{2c_2} + \frac{z_2^* d_2 w}{2} + z_2^* y_2 w - \frac{a_3 d_2 w^2}{3c_3} - \frac{a_3 w^2 y_2}{2c_3} - \frac{b_3 d_2^2 w}{6c_3} - \frac{b_3 y_2 d_2 w}{2c_3} - \frac{b_3 y_2^2 w}{2c_3} + \frac{b_4 d_2^2 w}{6c_4} + \frac{b_4 y_2 d_2 w}{2c_4} + \frac{b_4 y_2^2 w}{2c_4} \tag{2}$$

This equation could also be used to calculate a vessel, which has a cargo area with the dimensions of a box. This means the upper and lower horizontal surfaces are of equal length, ($L_1$=$L_2$) and the volume formula becomes that of Equation 3 below.

$$V_1 = wL_1 z_1^* - \frac{aw^2 L_1}{2c} - \frac{bwL_1^2}{2c} \tag{3}$$

Basically, the exemplary equation above provides the volume equations for the geometric shapes needed to calculate the volume of vessel 10 (in the example a Rake barge). As stated above, it is fully contemplated that the software could use any volume equation or geometric shape without departing from the spirit of the invention. The calculation of the volume of the introduced payload is performed by dividing the cargo space of vessel 10 below the water line into geometric shapes of which the volume equations are known. These volumes are then calculated to provide a volume, or the volume taken up by material 12. Then the density of material 12 loaded on vessel 10 is used to calculate the mass of material 12 (e.g., X pounds of corn with 15% moisture per Y cubic feet). In the alternative, the formulas could also be implemented as a simple lookup table where the user inputs into the software the type of material 12 and the software accesses the correct conversion or formula stored in memory.

The variables $I_1$, $I_2$, h, and w are manually entered by an operator at a user interface or can be recalled from a file set storing the parameters of a particular vessel. To facilitate the computation process vessels may be marked with an identifier, which can then be used to recall the parameters of the vessel from a stored file set.

For the purpose of a more detailed understanding of the present invention, the following example of a volume and mass calculation for a Rake barge is presented. For the purposes of this example, and this example only, the following values are utilized. Therefore:

| | | |
|---|---|---|
| $z_1$ | Sensor | 20 ft |
| $z_2$ | Sensor | 24 ft |
| $z_3$ | Sensor | 23 ft |
| $z_4$ | Sensor | 18 ft |
| h | Data Table/Manual Entry | 30 ft |
| w | Data Table/Manual Entry | 50 ft |
| $I_1$ | Data Table/Manual Entry | 50 ft |
| $I_2$ | Data Table/Manual Entry | 60 ft |

The software then performs the calculations of equation #2 with the sensor information and with the manually entered or data table variable information. Using equation #2 above, the volume of material 12 is calculated at 56271.1 cubic feet. Next, the software obtains the density of material 12 either from a lookup table, from memory, or from user input to calculate the weight of material 12. For example, if corn with 15% moisture weighs 56 pounds per bushel and there is 1.068 cubic feet per bushel, then the weight of material 12 is 52.434 pounds per cubic foot of 15% corn. Therefore, the total weight of material 12 calculates to 2,950,518 pounds of corn on board vessel 10.

The draft of the vessel can be measured at any time, so long as the sensors are in place and the receiving station is operable. The draft can be measured regardless of any ongoing processes (e.g., before, during, and after the introduction of the payload). Further, it is contemplated that the software could sound an alarm if the any draft exceeded a predetermined limit.

It will be appreciated that the present invention can take many forms and embodiments. The true essence and spirit of this invention are defined in the appended claims, and it is not intended that the embodiment of the invention presented herein should limit the scope thereof.

What is claimed is:

1. An apparatus for providing the mass of payload introduced into a water-borne vessel comprising:

a plurality of sensors removably attached about a perimeter of the vessel at a distance above a waterline of the vessel, each sensor producing a height signal of the sensor above the waterline; and a processor which can process the signals, the processor being capable of providing the volume and mass of the payload.

2. The apparatus of the claim 1 further including a transmitting device coupled to at least one of the plurality of sensors.

3. The apparatus of the claim 2 wherein each of the plurality of sensors is coupled to a transmitting device.

4. The apparatus of claim 3 wherein four sensors are positioned at locations defining four corners of the water-borne vessel.

5. The apparatus of claim 3 wherein the at least one sensor is capable of detecting the ambient air temperature.

6. The apparatus of claim 3 wherein the sensors are ultrasonic level sensors.

7. The apparatus of claim 6 wherein the sensors are battery powered.

8. The apparatus of claim 7 wherein the sensors are capable of detecting information regarding the charge state of the batteries.

9. The apparatus of claim 8 wherein at least one sensor includes a microprocessor for correcting the signals for any water surface disturbances.

10. The apparatus of claim 9 wherein the processor is capable of generating a representation of the vessel with a real-time depiction of the list and trim of the vessel.

11. The apparatus of claim 10 wherein the processor is capable of storing the draft of the vessel in an unloaded condition.

12. The apparatus of the claim 2 wherein the transmitting device transmits the signals produced by the sensors.

13. The apparatus of claim 12 wherein a receiving station coupled to the processor receives the transmitted signals and routes them to the processor.

14. An apparatus for calculating the mass of a payload introduced into a water-borne vessel comprising:

a first sensor removably attachable to a first position of a water-borne vessel at a height above a waterline of the water floating the vessel, the sensor being capable of producing a first signal representative of the distance between a port position of the water-borne vessel and the waterline;

a second sensor removably attachable to a second position of the water-borne vessel at height above a waterline of the water floating the vessel, the sensor being capable of producing a second signal representative of the distance between a starboard position of the water-borne vessel and the waterline;

a third sensor removably attachable to a third position of the water-borne vessel at height above a waterline of the water floating the vessel, the sensor being capable of producing a third signal representative of the distance between a aft position of the water-borne vessel and the waterline;

a fourth sensor removably attachable to a fourth position of the water-borne vessel at height above a waterline of the water floating the vessel, the sensor being capable of producing a fourth signal representative of the distance between a fore-position of the water-borne vessel and the waterline; and a processor that receives and processes the signals, the processor being capable of producing the volume and mass of the payload by comparing the draft of the vessel in an unloaded condition to a loaded condition.

15. The apparatus of claim 14 wherein the sensors are ultrasonic level sensors.

16. The apparatus of claim 14 wherein the first, second, third, and fourth positions are aft-port, aft-starboard, fore-port, and fore-starboard corners of the vessel, respectively.

17. The apparatus of claim 14 wherein at least one sensor includes a microprocessor for correcting for any surface water disturbance.

18. The apparatus of claim 14 further including a transmitting device coupled to at least one sensor.

19. The apparatus of claim 14 wherein the sensors are capable of detecting the ambient air temperature.

20. The apparatus of claim 14 wherein the sensors are powered by a battery.

21. The apparatus of claim 20 wherein the sensors are capable of detecting information regarding the charge of the batteries.

22. The apparatus of claim 14 wherein the processor is capable of displaying a representation of the vessel with a real-time depiction of the list and trim.

23. The apparatus of claim 14 wherein the processor is capable of storing the draft of the vessel in an unloaded condition.

24. A method for determining the mass of a payload introduced into a water-borne vessel comprising:

removably attaching a plurality of sensors around the perimeter of the vessel at a height above a waterline of the water floating the vessel;

generating height signals of the distance between each sensor and the waterline;

generating the draft of the vessel from the signals; and comparing the generated draft of the vessel to a predetermined draft of the vessel without the payload to determine and display the mass of the payload.

25. The method according to claim 24 wherein the sensors are ultrasonic level sensors.

26. The method according to claim 24 wherein at least four sensors are positioned at an art-port, aft-starboard, fore-port, and fore-starboard corner of the vessel, respectively.

27. The method according to claim 24 and including displaying a real-time depiction of the list and trim of the vessel.

* * * * *